US007916105B2

(12) United States Patent
Ki-Min et al.

(10) Patent No.: US 7,916,105 B2
(45) Date of Patent: Mar. 29, 2011

(54) LIQUID CRYSTAL DISPLAY DEVICE AND METHOD OF DRIVING THE SAME

(75) Inventors: Woong Ki-Min, Daegu-si (KR); Jae Woo Lee, Gumi-si (KR); So Hyuk Jang, Daegu-si (KR)

(73) Assignee: LG Display Co., Ltd., Seoul (KR)

( * ) Notice: Subject to any disclaimer, the term of this patent is extended or adjusted under 35 U.S.C. 154(b) by 792 days.

(21) Appl. No.: 11/590,790

(22) Filed: Nov. 1, 2006

(65) Prior Publication Data

US 2008/0001880 A1 Jan. 3, 2008

(30) Foreign Application Priority Data

Jun. 30, 2006 (KR) ..... 10-2006-0061277

(51) Int. Cl.

| | |
|---|---|
| ***G09G 3/34*** | (2006.01) |
| ***G09G 3/36*** | (2006.01) |
| ***G09G 5/02*** | (2006.01) |
| ***G09G 5/00*** | (2006.01) |

(52) U.S. Cl. ..... 345/89; 345/84; 345/87; 345/589; 345/617

(58) Field of Classification Search ..... None
See application file for complete search history.

(56) References Cited

U.S. PATENT DOCUMENTS

| | | | | |
|---|---|---|---|---|
| 6,756,955 | B2 * | 6/2004 | Someya et al. | 345/88 |
| 6,762,800 | B1 * | 7/2004 | Nie et al. | 348/687 |
| 6,980,225 | B2 * | 12/2005 | Funamoto et al. | 345/691 |
| 7,154,556 | B1 * | 12/2006 | Wang et al. | 348/452 |
| 7,427,993 | B1 * | 9/2008 | Zhang et al. | 345/600 |
| 2005/0184937 | A1 * | 8/2005 | Lee | 345/82 |
| 2006/0071936 | A1 * | 4/2006 | Leyvi et al. | 345/589 |
| 2006/0125775 | A1 * | 6/2006 | Itoh | 345/102 |
| 2006/0221186 | A1 * | 10/2006 | Lin et al. | 348/173 |

* cited by examiner

*Primary Examiner* — Bipin Shalwala
*Assistant Examiner* — Daniel Bedell
(74) *Attorney, Agent, or Firm* — Birch, Stewart, Kolasch & Birch, LLP

(57) ABSTRACT

A liquid crystal display device including a liquid crystal panel, a data driver configured to supply a pixel driving signal to pixels on the liquid crystal panel in one line unit, an input unit configured to input video data to be supplied to the data driver, a low gray scale compensator configured to compensate a low gray scale value video data in the video data received from the input unit to generate a high gray scale value video data, and a selection controller configured to detect a brightness of the video data received from the input unit, and to selectively supply the high gray scale value video data received from the low gray scale compensator or the video data received from the input unit.

12 Claims, 4 Drawing Sheets

LIQUID CRYSTAL DISPLAY DEVICE AND METHOD OF DRIVING THE SAME

This application claims priority to Korean Patent Application No. 10-2006-0061277 filed on Jun. 30, 2006 in Korea, the entire contents of which is hereby incorporated by reference in its entirety.

BACKGROUND OF THE INVENTION

1. Field of the Invention

The present invention relates to a liquid crystal display (LCD) device and corresponding method that compensates a low gray scale value.

2. Description of the Related Art

A cathode ray tube (CRT) has been widely used as a display device. However, an active matrix LCD device is now becoming more popular. Further, the LCD device displays an image by adjusting an amount of plane light in pixel units. The plane light passes through a liquid crystal layer included in the LCD device in which liquid crystal molecules are differently aligned to display an image.

In addition, the LCD device is generally used in notebook computers and desktop computers. However, the LCD is also beginning to be used as image display devices for televisions. Thus, the LCD device used in televisions has to display images clearly.

However, when images are dark, the outline of the images displayed by the LCD device is not clear. Therefore, because the LCD device fails to display clear images, the reliability of the LCD is reduced.

SUMMARY OF THE INVENTION

Accordingly, one object of the present invention is to address the above-noted and other problems.

Another object of the present invention is to provide an LCD device and corresponding driving method for clearly displaying an image.

Yet another object of the present invention is to provide an LCD device with an improved reliability.

To achieve these objects and other advantages and in accordance with the purpose of the invention, as embodied and broadly described herein, the present invention provides in one aspect, a liquid crystal display device including a liquid crystal panel, a data driver configured to supply a pixel driving signal to pixels on the liquid crystal panel in one line unit, an input unit configured to input video data to be supplied to the data driver, a low gray scale compensator configured to compensate a low gray scale value video data in the video data received from the input unit to generate a high gray scale value video data, and a selection controller configured to detect a brightness of the video data received from the input unit, and to selectively supply the high gray scale value video data received from the low gray scale compensator or the video data received from the input unit.

In another aspect, the present invention provides a method of driving a liquid crystal display device. The method includes supplying a pixel driving signal to pixels on a liquid crystal panel in one line unit, compensating low gray scale value video data in input video data being supplied to a data driver, to generate high gray scale value video data, and detecting a brightness of the video data and selectively supplying the video data according to the detected brightness.

In yet another aspect, the present invention provides a method of driving a liquid crystal display device. The method includes determining if pixel data of input video data has a gray scale value that is less than a first predetermined reference, accumulating a number of pixel data that is less than the first predetermined reference, determining if the accumulated number of the pixel data that is less than the first predetermined reference is over a second predetermined reference, compensating the gray scale value of the pixel data, and selectively outputting the compensated pixel data to the liquid crystal panel. The present invention also provides a corresponding liquid crystal display device.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by illustration only, and thus are not limitative of the present invention, and wherein.

DETAILED DESCRIPTION OF THE INVENTION

Reference will now be made in detail to the preferred embodiments of the present invention, examples of which are illustrated in the accompanying drawings.

Figure 1:
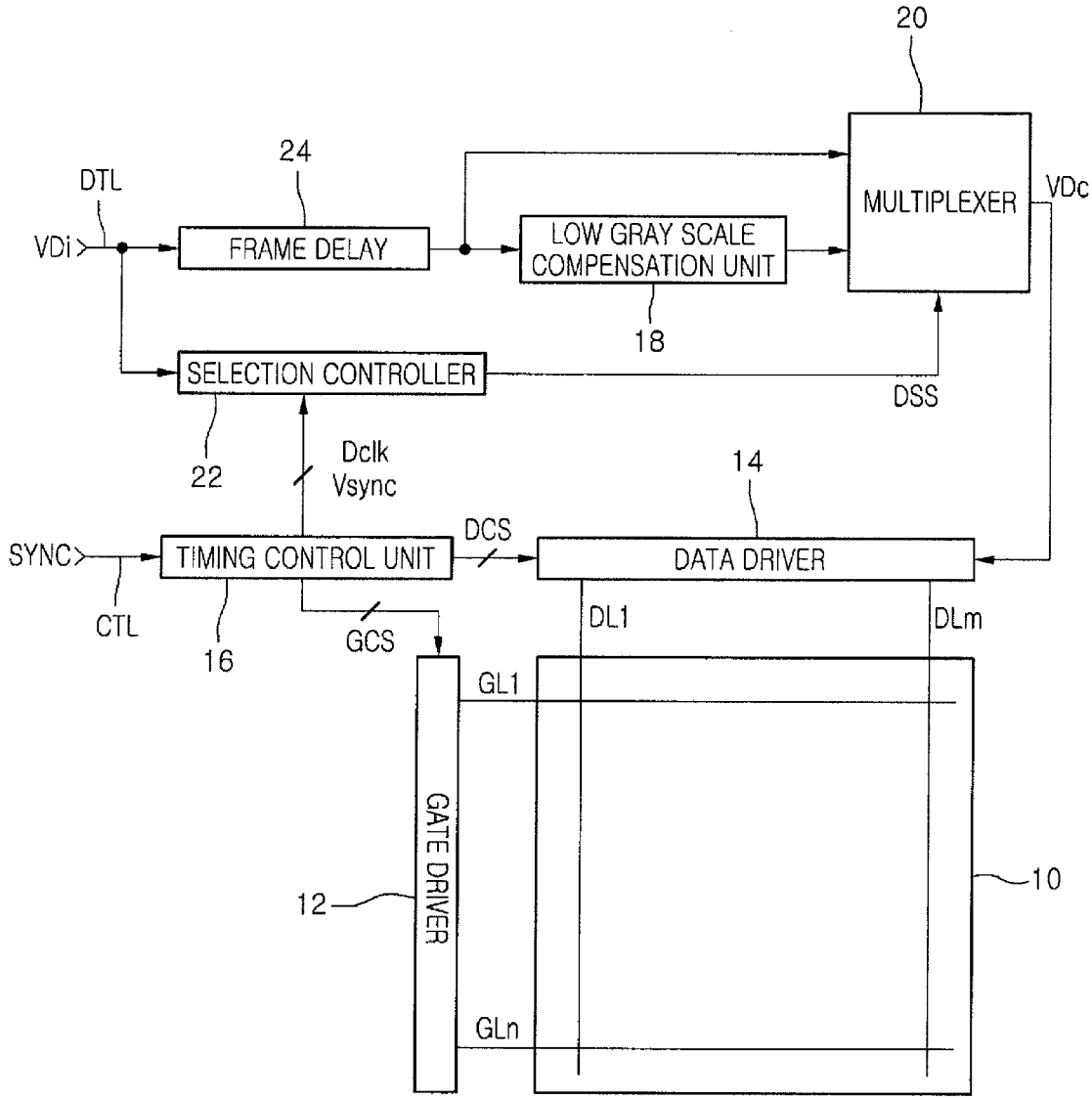
FIG. 1 is a block diagram of an LCD device according to an embodiment of the present invention.

Turning first to FIG. 1, which is a block diagram of an LCD device according to an embodiment of the present invention. As shown, the LCD device includes a gate driver 12 connected to a plurality of gate lines GL1 to GLn on a liquid crystal panel 10, and a data driver 14 connected to a plurality of data lines DL1 to DLm on the liquid crystal panel 10.

Further, the gate lines GL1 to GLn and the data lines DL1 to DLm intersect each other on the liquid crystal panel 10 to thereby define a plurality of pixel regions. Also, in each pixel region, a thin film transistor (not shown) is formed so as to switch a pixel driving signal being applied from a corresponding data line DL to a corresponding liquid crystal cell (not shown) in response to a scan signal on a corresponding gate line GL.

In addition, the liquid crystal cell displays an image by adjusting an amount of light that passes through the pixel region according to a voltage level of the pixel driving signal. Consequently, a pixel including one thin film transistor and one liquid crystal cell is formed in each pixel region.

Further, the gate driver 12 enables the plurality of gate lines GL1 to GLn sequentially and exclusively by a predetermined period (i.e., a period of one horizontal synchronization signal) during one frame. For this purpose, the gate driver 12 generates a plurality of scan signals having enable pulses shifted sequentially and exclusively at each period of the horizontal synchronization signal.

The gate enable pulse in each scan signal has a width equal to the period of the horizontal synchronization signal. Also, the gate enable pulse in each scan signal is generated one time at each frame period. Further, the data driver 14 generates as many pixel driving signals as the data lines DL1 to DLm, that is, the number of pixels arranged in one gate line whenever any one of the gate lines GL1 to GLn is enabled.

In addition, each pixel driving signal corresponding to one line is supplied to a corresponding pixel (i.e., liquid crystal cell) on the liquid crystal panel 10 via a corresponding data line. Further, each pixel arranged on the gate lines passes an amount of light corresponding to a voltage level of the pixel driving signal. Also, to generate pixel driving signals for one line, the data driver 14 sequentially inputs pixel data corresponding to one line at a period of one horizontal synchronization signal, and simultaneously converts the sequentially input pixel data into an analog format.

In addition, a timing controller 16 controls the gate driver 12 and the data driver 14. The timing controller 16 receives synchronization signals SYNC from an external video data source (e.g., an image signal modulator in a television receiving module, or a graphic card in a computer system) through a control transmission line CTL. The synchronization signals SYNC include a data clock Dclk, a horizontal synchronization signal Hsync, and a vertical synchronization signal Vsync, for example.

Further, the timing controller 16 generates gate control signals GCS used by the gate driver 12 to generate a plurality of scan signals at each frame using the synchronization signals SYNC. Moreover, the timing controller 16 generates data control signals DCS used by the data driver 12 to sequentially input pixel data of one line at each period of the horizontal synchronization signal, to convert the sequentially input pixel data of one line into a pixel driving signal in an analog form and to output the converted signal.

In addition, as shown in FIG. 1, the LCD device also includes a low gray scale compensator 18 and a multiplexer 20 connected in series between the data transmission line DTL and the data driver 14. The data transmission line DTL is also connected to the external video data source (e.g., an image signal modulator in a television receiving module, or a graphic card in a computer system) to receive video data VDi. The video data VDi includes pixel data, which are sequentially arranged and divided into a frame unit (one image unit).

Further, the low gray scale compensator 18 compensates the difference between gray scales of pixel data that are below a predetermined gray scale level in the video data VDi received from the data transmission line DTL. That is, the low gray scale compensator 18 converts the pixel data such that low gray scale levels (e.g., gray scale levels 0 to 30) correspond to high gray scale levels (e.g., gray scale levels 0 to 40).

Figure 2:
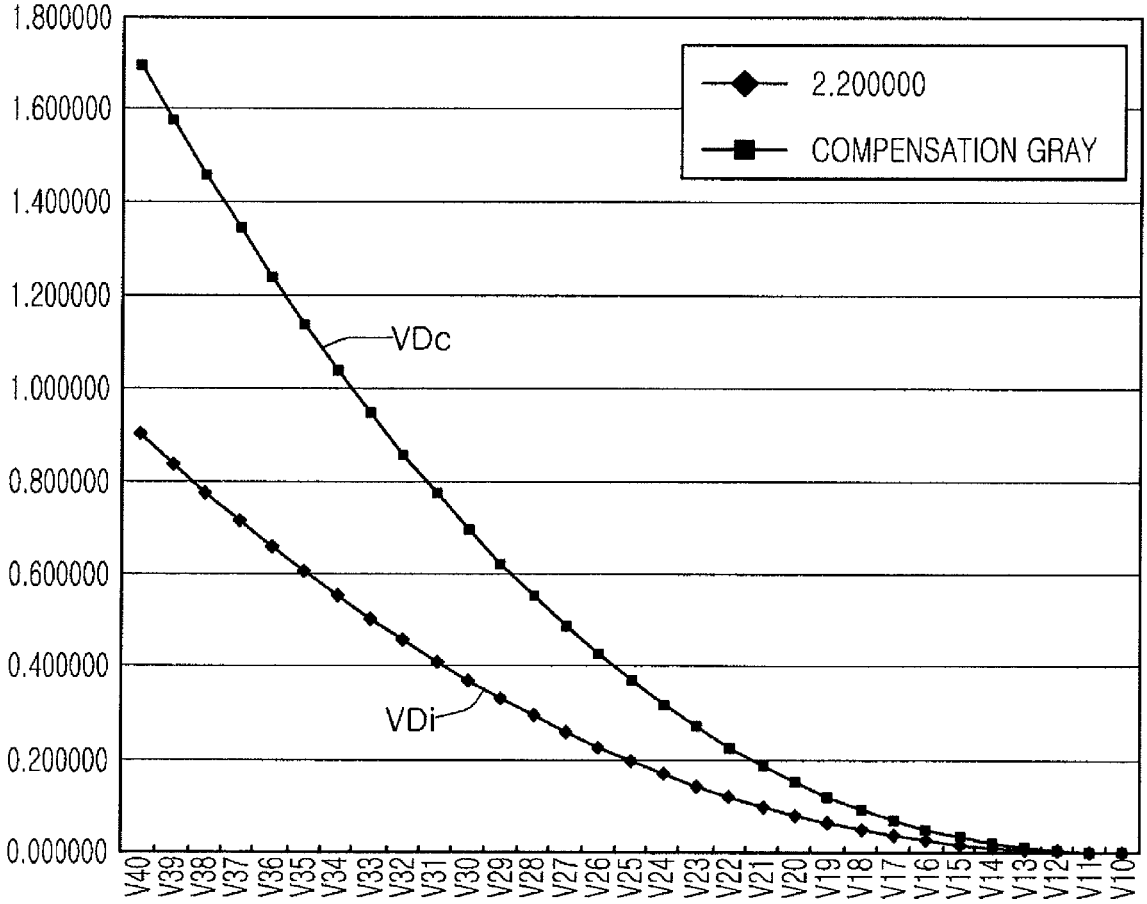
FIG. 2 is a graph describing a compensation characteristic in a low gray scale compensator in FIG. 1.

The pixel data VDc that is gray scale-converted by the low gray scale compensator 18 has an increased voltage difference between the pixel driving signals according to the difference between gray scale levels when compared to the input pixel data VDi. Accordingly, the brightness (i.e., an amount of light passing though each liquid crystal cell) of each pixel on the liquid crystal panel 10 sharply changes depending on the gray scale-converted pixel data VDc compared to the input pixel data Vdi, as illustrated in FIG. 2.

In addition, the multiplexer 20 selects any one of the pixel data VDi from the data transmission line DTL and the pixel data from the low gray scale compensator 18. Also, the multiplexer 20 supplies the selected pixel data to the data driver 14. The selecting of the pixel data in the multiplexer 20 is controlled by a selection controller 22.

Further, the selection controller 22 controls the selection of the pixel data in the multiplexer 20 in response to the brightness of images included in the pixel data VDi from the data transmission line DTL. When the images are dark, the selection controller 22 allows the multiplexer 22 to alternately transmit to the data driver 14 either the gray scale-converted pixel data VDc or the pixel data VDi.

In addition, when the gray scale-converted pixel data VDc is output from the low gray scale compensator 18, the multiplexer 20 supplies the gray scale-converted pixel data VDc to the data driver 14. On the contrary, when the gray scale-converted pixel data VDc is not output from the low gray scale compensator 18, the multiplexer 20 supplies the input pixel data VDi received from the data transmission line DTL to the data driver 14.

However, when the image including the input pixel data VDi is bright, the selection controller 22 allows the multiplexer 22 to only transmit the input pixel data VDi, even if the gray scale-converted pixel data VDc is output from the low gray scale compensator 18. Additionally, the selection controller 22 uses the data clock Dclk and the vertical synchronization signal Vsync received from the timing controller 16 so as to generate a data selection signal DSS supplied to the multiplexer 20 according to the brightness of images corresponding to the input pixel data VDi.

More specifically, the selection controller 22 divides the input pixel data VDi into a frame (image) unit using the vertical synchronization signal Vsync. The selection controller 22 then detects whether or not the pixel data VDi below a predetermined gray scale level (e.g., gray scale level 30) is over a reference amount (e.g., 70%) in the frame divided by the data clock Dclk.

According to a result of the detection, the selection controller 22 generates the data selection signal DSS having a high or low logic value. According to the logic value of the data selection signal DSS, the multiplexer 20 selects one of the gray scale-converted pixel data VDc and the input pixel data VDi.

In addition, as shown in FIG. 1, the LCD device also includes a frame delay unit 24 that delays the pixel data VDi by a period of one frame. The pixel data VDi is then supplied from the data transmission line DTL to the low gray scale compensator 18 and the multiplexer 20. The frame delay 24 compensates a difference in a propagation delay time between the input pixel data VDi supplied to the multiplexer 20, the gray scale-converted pixel data VDc, and the data selection signal DSS supplied from the selection controller 22 to the multiplexer 20.

Figure 3:
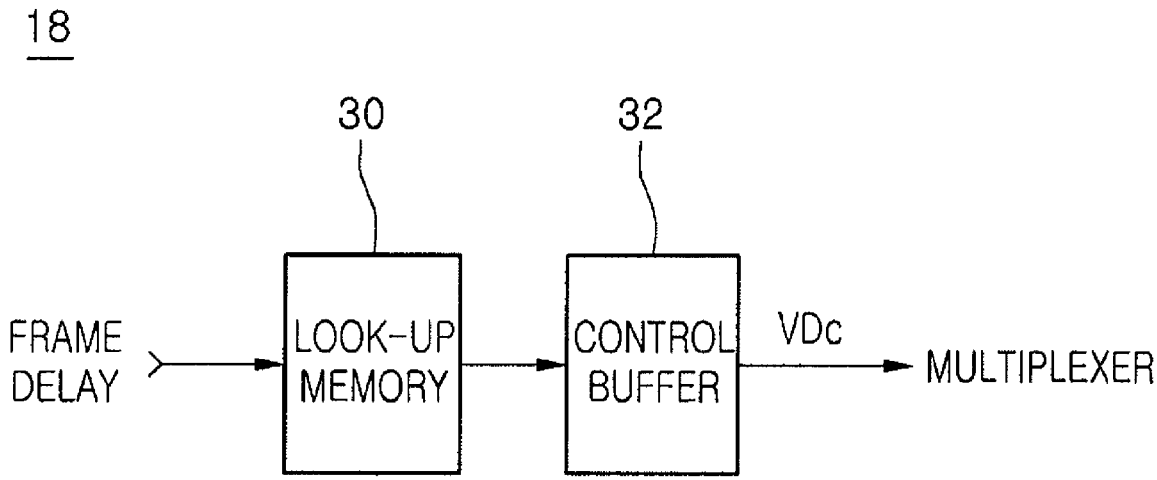
FIG. 3 is a block diagram of a low gray scale compensator in FIG. 1.

Turning next to FIG. 3, which is a block diagram of the low gray scale compensator 18 in FIG. 1. As shown, the low gray scale compensator 18 includes a look-up memory 30 and a control buffer 32 connected in series to the frame delay unit 24 in FIG. 1. The look-up memory 30 stores gray scale-converted pixel data VDc including 30 gray scale levels in the second integer gray scale levels (e.g., gray scale levels 0 to 40) corresponding to the first integer low gray scale levels (e.g., gray scale levels 0 to 30) of the input pixel data VDi.

The look-up memory 30 outputs the gray scale-converted pixel data VDc in response to a predetermined number of lower bit pixel data (e.g., lower 5 bit data) designating a gray scale value below a first n-th gray scale level (n is integer) in bit data of the pixel data VDi. In other words, while the pixel data VDi input from the frame delay 24 includes 8 bits, the look-up memory 30 supplies the 8 bits scale-converted pixel data VDc stored in the storage region and corresponding to a logic value of the lower 5 bits in the 8 bit pixel data to the control buffer 32.

Further, a table of the look-up memory 30 stores values corresponding to the gray scale voltages for all input pixel data, and converts the input frame data into the values stored in the look-up memory 30. In addition, because only the low gray scale voltages have to be converted into high gray scale voltages, the values of the 0 to 30 gray scale levels are increased and the values of 31 to 255 gray scale levels are maintained without any change. Other range values may be selected. That is, regardless of the brightness or darkness of the overall image, the low gray scale levels in the frame unit are gray scale-compensated. Also, the selection controller determines whether or not to output the compensated image.

Figure 4:
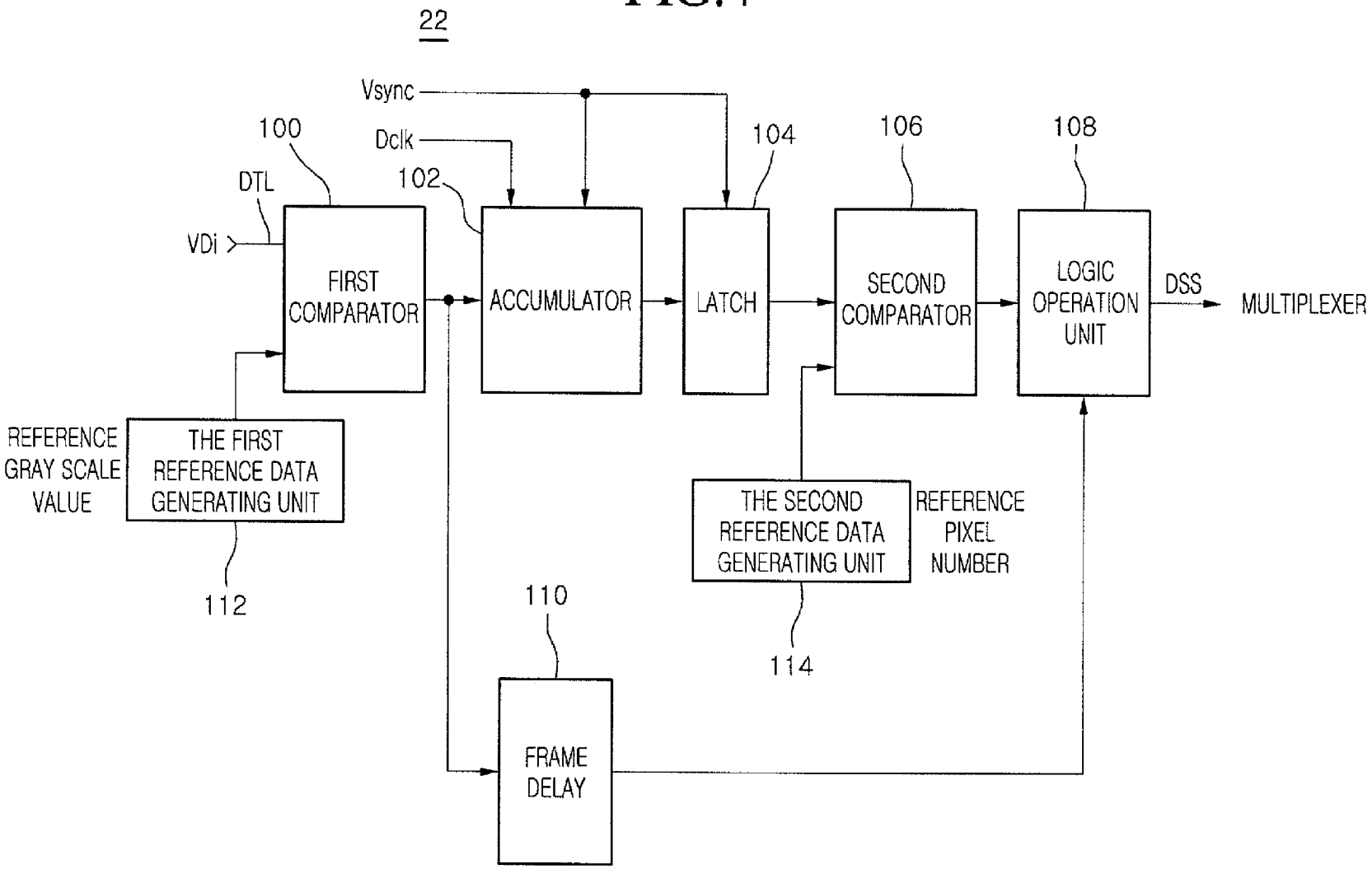
FIG. 4 is a block diagram of a selection controller in FIG. 1.

Next, FIG. 4 is a block diagram of the selection controller 22 in FIG. 1. As shown, the selection controller 22 includes a first comparator 100, an accumulator 102, a latch 104, a second comparator 106, and a logic operation unit 108 connected in series to the data transmission line DTL in FIG. 1. Also included is a first reference data generating unit 112 that supplies the reference gray scale data RD to the first comparator 100. Further, a second reference data generating unit 114 supplies the reference pixel number data RND to the second comparator 106.

The reference gray scale data RD generated in the first reference data generating unit 112 is set to have a gray scale value equal to a limit gray scale value (e.g., gray scale level 30) of the pixel data VDi that will be gray-scaled. The reference pixel number data RND generated in the second reference data generating unit 114 is the number of low gray scale pixel data VDi indicating whether images including the pixel data VDi are bright or dark.

The number is set by the number of images corresponding to 70% of the number of the pixels formed on the liquid crystal panel 10. Other percent values may be selected besides 70%. In addition, the first and second reference data generating units 112, 114 preferably include register or key switches.

Moreover, the comparator 100 generates a first compare signal having a specific logic value (e.g., a high or low logic value) when the pixel data VDi received from the data transmission line DTL is equal to or below the reference gray scale data RD supplied from the first reference data generating unit 112. That is, the first comparator 100 detects the pixel data VDi (i.e., the pixel data that will be gray-scaled) of a low gray scale value in the reference gray scale data RD.

The accumulator 102 then counts the number of low gray scale pixel data VDi in the pixel data of one frame. Therefore, the accumulator 102 initializes a counter value during blanking of the vertical synchronization signal Vsync. Additionally, the accumulator 102 increases by one the number of the first compare signals of the specific logic value in response to a data clock Dclk. The data clock Dclk and the vertical synchronization signal Vsync are supplied from the timing controller 16 in FIG. 1 to the accumulator 102.

Then, the latch 104 samples the number of the low gray scale pixel data during one frame period, and supplies the sampled number to the second comparator 106. That is, the latch 104 latches the number of the low gray scale pixel data supplied from the accumulator 102 in response to the vertical synchronization signal Vsync received from the timing controller 15 in FIG. 1. More specifically, the latch 104 latches the number of low gray scale pixel data in a specific edge of the vertical synchronization signal Vsync that indicates a transition from a scanning period into a blanking period.

The second comparator 106 then compares the number of the low gray scale pixel data from the latch 104 with the number of the reference pixel number data RND supplied from the second reference data generating unit 114. When the number of the low gray scale pixel data is larger than the logic value of the reference pixel number data RND, the second comparator 106 generates a second compare signal of a specific logic value (e.g., a high or low logic value) indicating that an image is dark. On the contrary, when the number of the low gray scale pixel data is smaller than the logic value of the reference pixel number data RND, the second comparator 106 generates a second compare signal of a specific logic indicating that an image is bright.

The logic operation unit 108 then logically operates a first compare signal supplied from the first comparator 100 and a second compare signal supplied from the second comparator 106 to generate a data selection signal DSS supplied to the multiplexer 20 in FIG. 1. The data selection signal DSS has a waveform identical to or inverted to that of the first compare signal when the second compare signal maintains a specific logic value (e.g., a high or low logic value), that is, when an image is dark.

In addition, the multiplexer 20 in FIG. 1 selectively supplies the pixel data VDi received from the frame delay 24 and the gray scale-converted pixel data VDc from the low gray scale compensator 18 to the data driver 14. On the contrary, when the second compare signal has a logic value (e.g., a high or low logic value) different from a specific logic value, that is, when an image is bright, the data selection signal DSS maintains the specific logic value or the logic value different from the specific logic value. Then, the multiplexer 20 in FIG. 1 continuously supplies the pixel data received from the frame delay 24 to the data driver 14.

Moreover, as shown in FIG. 4, the selection controller 18 further includes a second frame delay unit 110 connected between the first comparator 100 and the logic operation unit 108. The second frame delay 110 delays the first compare signal supplied from the first comparator 100 to the logic operation unit 109 during one frame period corresponding to a delay time of a signal process until the second compare signal is generated from the first compare signal. That is, the second frame delay 110 synchronizes the timing of the second compare signal and the first compare signal supplied from the logic operation unit 108.

As described above, the LCD device of the present invention increases a gray scale value of a low gray scale video data by gray scale-converting the low gray scale video data. Accordingly, an outline of the dark image becomes apparent such that the image becomes more clearly displayed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A liquid crystal display device, comprising:

a liquid crystal panel;

a data driver configured to supply a pixel driving signal to pixels on the liquid crystal panel;

an input unit configured to provide input video data to be supplied to the data driver;

a low gray scale compensator configured to compensate a low gray scale value video data in the input video data to generate a high gray scale value video data;

a selection controller configured to detect a brightness of the input video data;

a frame delay unit configured to delay the input video data transmitted from the input unit to the low gray scale compensator; and a multiplexer configured to select the input video data or the high gray scale value video data generated by the low gray scale compensator, wherein the multiplexer is controlled by the selection controller, and wherein the selection controller includes;

a first comparator configured to compare a gray scale value of the input video data with a reference gray scale value;

an accumulator configured to count a number of low gray scale value video data in the first video data of one frame in response to a data clock according to the comparison result from the first comparator to produce a counted number;

a latch configured to sample the counted number produced by the accumulator;

a second comparator configured to compare the counted number sampled by the latch with a reference pixel number; and a logic operation unit configured to perform a logic operation on the comparison results of the first comparator and the second comparator to generate a selection control signal for controlling the multiplexer.

2. The liquid crystal display device according to claim 1, wherein the low gray scale compensator comprises:

a look-up memory configured to output the generated high gray scale value video data corresponding to the gray scale value of the first video data received from the input unit; and a control buffer configured to retrieve the generated high gray scale value video data from the look-up memory.

3. A method of driving a liquid crystal display device, the method comprising:

supplying a pixel driving signal to pixels on a liquid crystal panel;

compensating low gray scale value video data in input video data being supplied to a data driver, to generate high gray scale value video data;

detecting a brightness of input video data;

delaying the input video data prior to compensating the low gray scale value video data; and selecting the input video data or the high gray scale value video data by a multiplexer, and wherein detecting the brightness of the input video data includes;

comparing a gray scale value of the input video data with a reference gray scale value, by a first comparator to produce a first comparison result;

counting the number of low gray scale value video data in the input video data of one frame in response to a data clock according to the comparison result to produce a counted number;

sampling the counted number to produce a sampled value;

comparing the sampled value with a reference pixel number by a second comparator to produce second comparison results; and logically operating on the first and second comparison results to generate a selection control signal for controlling the multiplexer.

4. The method according to claim 3, wherein compensating the low gray scale value video data comprises compensating the low gray scale value video data according to a reference of a look-up table.

5. A method of driving a liquid crystal display device, the method comprising:

determining if first pixel data of input video data has a gray scale value that is less than a first predetermined reference;

accumulating a number of the first pixel data having a gray scale value that is less than the first predetermined reference to produce an accumulated number;

determining whether or not the accumulated number is greater than a second predetermined reference;

compensating the gray scale value of the first pixel data to produce compensated pixel data; and selectively outputting by a multiplexer one of the compensated pixel data and the first pixel data to the liquid crystal panel according to whether or not the first pixel data of input video data has a gray scale value that is less than a first predetermined reference and according to whether of not the accumulated number is greater than the second predetermined reference.

6. The method according to claim 5, further comprising:

dividing the input video data into frames.

7. The method according to claim 6, wherein the compensating step compensates the gray scale value on a frame by frame basis.

8. The method according to claim 5, wherein the compensating step comprises:

compensating the first pixel data having a low gray scale value to generate the compensated pixel data having a higher gray scale value.

9. A liquid crystal display device, comprising:

a first comparator configured to determine if first pixel data of input video data has a gray scale value that is less than a first predetermined reference;

an accumulator configured to accumulate a number of the first pixel data having a gray scale value that is less than the first predetermined reference to produce an accumulated number;

a second comparator configured to determine whether or not the accumulated number is greater than a second predetermined reference;

a logic operation unit configured to generate a selection control signal based on a first signal from the first comparator and a second signal from the second comparator;

a gray scale compensating unit configured to compensate the gray scale value of the first pixel data;

a frame delay unit configured to delay the input video data to the gray scale compensating unit; and a multiplexer configured to selectively output one of the compensated pixel data and the first pixel data according to the selection control signal, wherein the multiplexer outputs the compensated pixel data according to the selection control signal indicating that the accumulated number is greater than the second predetermined reference, and wherein the multiplexer outputs the first pixel data according to the selection control signal indicating the accumulated number is not greater than the second predetermined reference.

10. The liquid crystal display according to claim 9, wherein the gray scale compensating unit compensates the gray scale value on a frame by frame basis, and compensates a low gray scale value first pixel data of the video data to generate a higher gray scale value compensated pixel data.

11. The liquid crystal display according to claim 9, wherein the gray scale compensating unit increases the gray scale value of the first pixel data such that an outline of a dark image is apparent when the liquid crystal display produces the dark image in response to the compensated pixel data.

12. The liquid crystal display according to claim 9, further comprising:

an outputting unit configured to output the compensated pixel data to the liquid crystal display.

* * * * *